United States Patent [19]

Chen

[11] Patent Number: 4,738,199

[45] Date of Patent: Apr. 19, 1988

[54] MULTICOLOR TRANSFER PRINTING APPARATUS

[76] Inventor: Regina Chen, Room 607, No. 57, Tun Hwa S. Road, Taipei, Taiwan

[21] Appl. No.: 8,949

[22] Filed: Jan. 30, 1987

[51] Int. Cl.[4] ..... B41F 17/00; B41F 17/22

[52] U.S. Cl. ..... 101/163; 101/44; 101/151

[58] Field of Search ..... 101/35, 41, 44, 163, 101/151, 150

[56] References Cited

FOREIGN PATENT DOCUMENTS 2565901 12/1985 France ..... 101/163

1143617 3/1985 U.S.S.R. ..... 101/163

*Primary Examiner*—Clifford D. Crowder

*Attorney, Agent, or Firm*—Angelo Notaro

[57] ABSTRACT

The present invention relates to a multi-purpose transfer printing apparatus comprising a stand, a main body and an upper portion to form a U-shaped frame. The stand is provided at the front with a conveyor and at the rear with an ink container seat, the upper portion being furnished with a front suspension arm which can be moved horizontally and vertically by a gas pneumatic cylinder and a rear suspension arm which can only be moved horizontally by a pneumatic cylinder. A plurality of ink containers each having a L-shaped member are arranged to dovetail into the ink container seat, and a plurality of silicon rubber heads respectively corresponding to the ink containers are arranged to dovetail into the front suspension arm. A plurality of blade seats respectively corresponding to the ink containers are arranged to dovetail into the rear suspension arm. The conveyor is provided with a plurality of V-shaped male members which can engage the corresponding V-shaped female members respectively secured to the L-shaped members, and a numerical control computer system can adjust the forward displacement per each printing cycle of the conveyor to cooperate with the control system disposed in the upper portion so as to effect the multi-color printing operation for various workpieces with different sizes and shapes.

5 Claims, 6 Drawing Sheets

MULTICOLOR TRANSFER PRINTING APPARATUS

BACKGROUND OF THE INVENTION

The present invention relates to a multi-purpose transfer printing apparatus and more particularly to one which comprises an adjustable conveyor and a plurality of replaceable ink containers, silicon rubber heads and blade seats whereby the multi-purpose transfer printing apparatus can be controlled by a numerical control system to effect the multi-color printing operation for various workpieces with different sizes and shapes, such as toys, shoes, stationery etc. Conventional transfer printing apparatus can be classified into two types, single color and multi-color.

FIG. 1 shows a perspective view of a conventional single color transfer printing apparatus which comprises a table(A), an ink container(B), a brush (C) and a silicon rubber head(D). The table(A) is provided with adjustable means(X) and (Y) which are used to adjust the position of the workpiece. Behind the table(A) the ink container (B) is disposed. The desired ink and the etched plate with desired pattern can respectively be placed into the ink container(B). The brush(C) together with the silicon rubber head(D) are mounted above the ink container(B). In operation, firstly place the etched plate with desired pattern into the ink container(B) and supply the ink container(B) with the desired ink. Secondly, lower the silicon rubber head(D) to absorb the ink received in the etched portion of the etched plate and then print the desired pattern onto the workpiece. Such single color transfer printing apparatus can only effect single color printing operation.

FIG. 2 shows a perspective view of a conventional four-color transfer printing apparatus which comprises four ink containers(B), four brushes(C) and four silicon rubber heads(D) which are similar to those illustrated in FIG. 1. A race track type conveyor(E) is arranged to cooperate with said ink containers(B), brushes(C) and silicon rubber heads(D) so as to simultaneously effect the four-color printing operation. The operating procedures of the four-color transfer printing apparatus are similar to those of the single color transfer printing apparatus.

Referring to FIG. 2, the conveyor(E) is provided with a plurality of stations(F) (See FIG. 2A) on which clamping means(G) can be mounted. In operation, we have to spend much time to align each workpiece on the station(F) with each corresponding silicon rubber head(D). Further, since the pins(H), which are used to position the station(F), are easily worn out (See FIG. 2*b*), the positioning accuracy of the station(F) lacks reliability. In addition, the plate , the silicon rubber head and the station all are not replaceable, the flexibility of the four-color transfer printing apparatus is significantly limited.

FIG. 3 is a perspective view of a conventional three-color transfer printing apparatus of which the structure is similar to that of the four-color transfer printing apparatus except for the disc type conveyor(I).

Conclusively, the disadvantages of the conventional transfer printing apparatus are as follows:

1. The stations disposed on the race track type conveyor/disc type conveyor are too many to be easily adjusted and the pins for positioning. The stations are easily worn out so that the printing result is not reliable.

2. Conventional transfer printing apparatus, either the single color type or the multi-color type can not increase the number of colors or replace the existing colors. Therefore the function of such apparatus is significantly limited.

3. Since the ink container, the silicon rubber head and the station of the conveyor of the conventional transfer printing apparatus all are fixed, the workpieces with different sizes and shapes can not be printed by a single apparatus.

4. Conventional transfer printing apparatus see the circuit board associated with a plurality of micro switches to continuously control the printing operation. However, such micro switch may easily cause poor contact or unexpected interrupt/disturbance so that the workpiece to be printed or silicon rubber head or brush will easily be destroyed.

SUMMARY OF THE INVENTION

A primary object of the present invention is to provide a multi-prupose transfer printing apparatus which utilizes the solenoid switch to control the movement of the silicon rubber heads and the brushes so as to provide a reliable printing operation.

Another object of the present invention is to provide a multi-purpose transfer printing apparatus which cooperates with a numerical control computer system as well as a servo/step motor to control the forward displacement per each printing cycle of the conveyor. A further object of the present invention is to provide a multi-purpose transfer printing apparatus which comprised replaceable ink containers, which can easily engage the corresponding seat, to adapt for various workpieces with different sizes and shapes and for multi-color printing operation.

A still further object of the present invention is to provide a multi-purpose transfer printing apparatus which comprises replaceable silicon rubber heads which can easily engage the suspension arm whereby the silicon rubber heads can move along the suspension arm to correspond to the ink containers.

A still further object of the present invention is to provide a multi-purpose transfer printing apparatus which utilizes the V-shaped male/female members so as to automatically fix the workpieces to be printed in the printing position.

DETAILED DESCRIPTION OF THE PREFERRED EMBODIMENT

Figure 1:
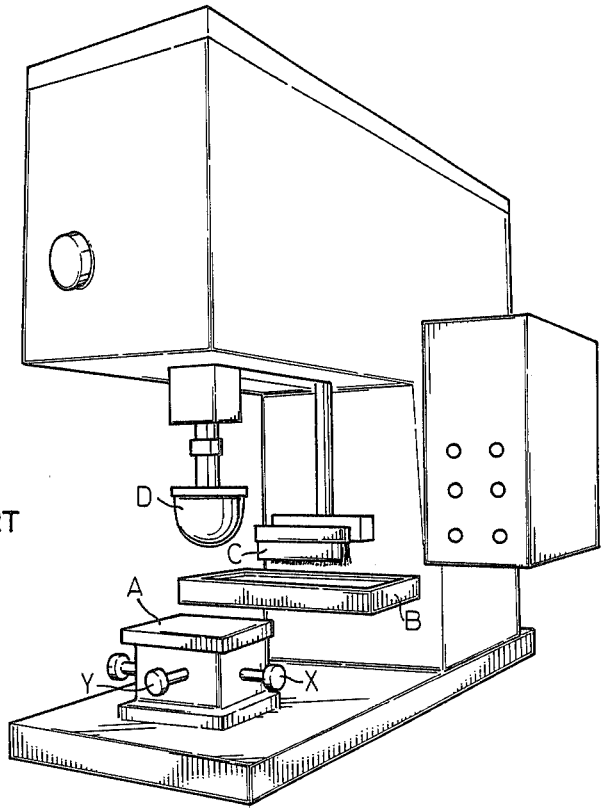
FIG. 1 PRIOR ART
FIG. 1 is a perspective view of a conventional single color transfer printing apparatus.
Figure 3:
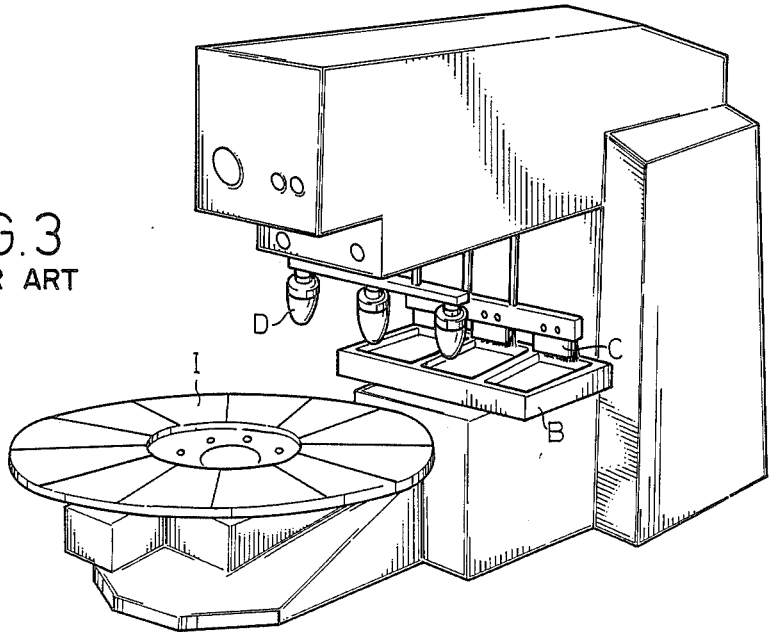
FIG. 3 PRIOR ART
FIG. 3 is a perspective view of a conventional three-color transfer printing apparatus with disc type conveyor.
Figure 2:
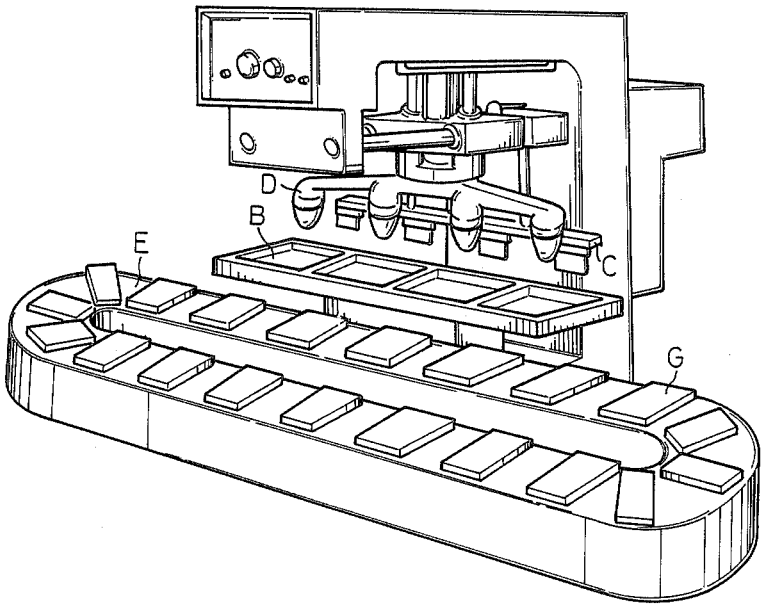
FIG. 2 PRIOR ART
FIG. 2 is a perspective view of a conventional four-color transfer printing apparatus with race track type conveyor.
Figure 2A:
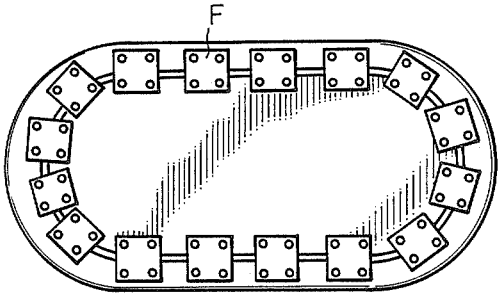
FIG. 2a PRIOR ART
FIG. 2*a* is a plan view of stations on a conveyor of FIG. 2.
Figure 2B:
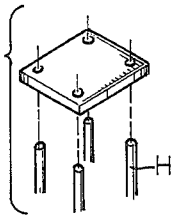
FIG. 2b PRIOR ART
FIG. 2*b* is an exploded view of pins for a station of FIG. 2.
Figure 4:
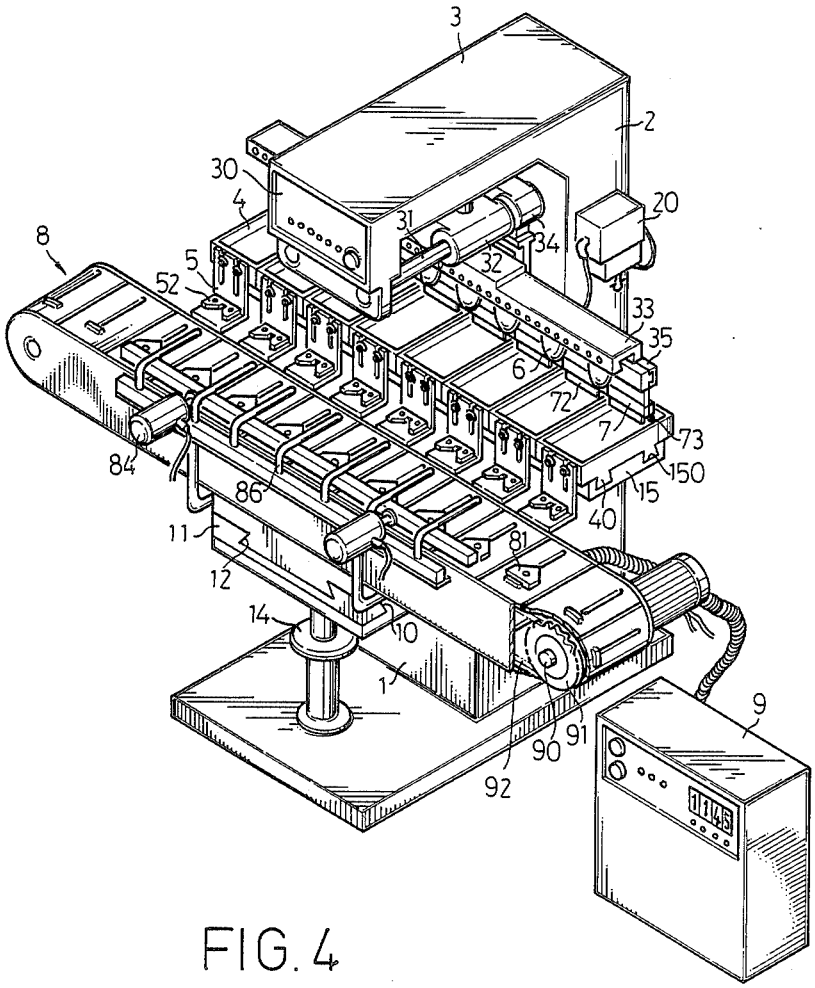
FIG. 4 is a perspective view of a preferred embodiment of the present invention.

Referring to FIG. 4, a preferred embodiment of the present invention comprises a stand(1), a main body(2) and an upper portion(3). The stand(1) is provided to the front with a dovetail groove(11) in which an adjustable seat(11) having a dovetail groove(12) formed thereon is disposed. The stand(1) further is provided at two lateral sides with an upper and a lower dovetail groove (not shown), which can be controlled by the a rotatable disc (14) to adjust the height of the seat (11). The adjustable seat(11) is furnished at the top with a rotary conveyor (8). Conveyor (8) can be moved by seat (11), riding in dovetail groove (10), by movement along dovetail groove (12) and by rotation of disc (14). The stand(1) is furnished at the rear with an ink container seat(15) having a pair of parallel dovetail grooves(150). The main body(2) extends upward from the rear portion of the stand(1). An ink container(4) is provided at one end with a L-shaped member(5) and at the botton with two opposite dovetails(40). The ink container (4) can be secured to the ink container seat(15) with the dovetails(40) respectively inserting into the corresponding dovetail grooves(150). The L-shaped member(5) is provided at the lower side with a V-shaped female member(52) which can engage the corresponding V-shaped male member (81) disposed on the conveyor (8).

The main body(2) is furnished at one side with a pneumatic cylinder system(20). The upper protion(3) extends horizontally from the top of the main body(2) to form a U-shaped space. The interior of the upper protion(3) is equipped with a control system(30). Beneath the upper portion(3) are two guide rods(31). A front slide station(32) and a rear slide station(34) are disposed on the guide rods(31) and can slide therealong. The front slide station(32) is provided with a suspension arm(33) having dovetail groove(331) (See FIG. 6) which is arranged to engage the corresponding dovetail formed on the silicon rubber head(6). The rear slide station(34) is furnished with a suspension arm(35) having dovetail groove(351) (See FIG. 7) which is arranged to engage the corresponding dovetail formed on the blade seat(7). The blade seat(7) is provided at the bottom with a blade(72) while a brush(73) is disposed behind the blade(72).

Figure 5:
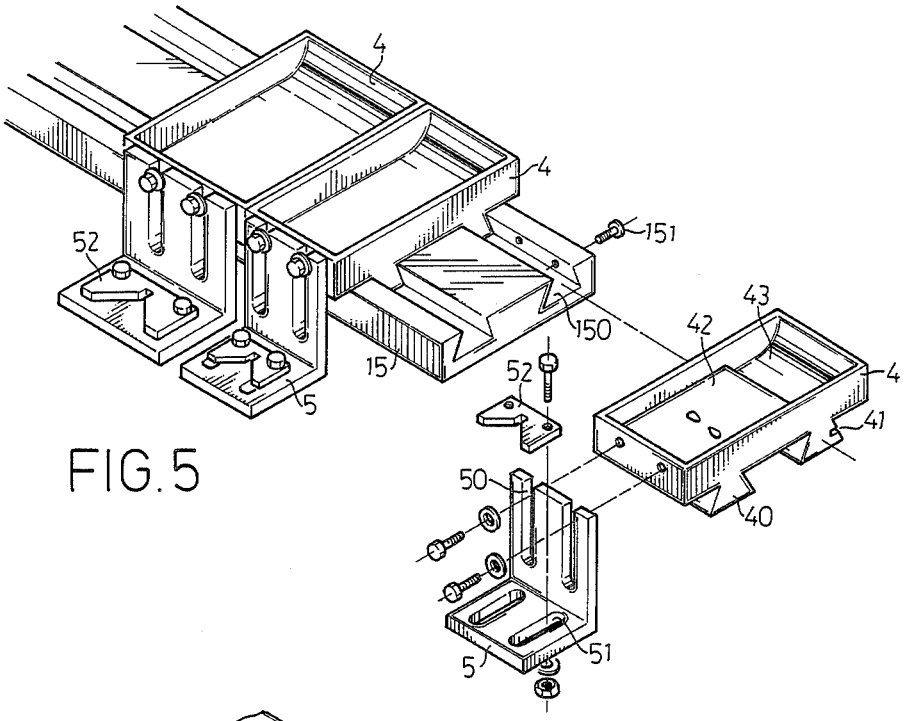
FIG. 5 is a fragmentary view showing a set of ink containers of the present invention.

Referring to FIG. 5, the ink container(4) with the L-shaped member(5) secured thereto can dovetail into the seat(15) and be fixed to position by means of a screw(151). The ink containers(4), as shown in FIG. 5, may have different sizes. However, when in operation, the ink containers(4) to be used should have the same size. The dovetail(40) of the ink container(4) is formed with a hole(41) to engage the screw(151). A plate(42) with the desired pattern etched thereon is properly disposed in the front portion of the ink container(4) while the rear portion thereof is used to receive the ink. The L-shaped member(5) has a pair of vertical grooves(50) which are arranged to slightly adjust the height of the aforesaid member(5) and further has a pair of horizontal grooves(51) which are arranged to adjust the application position of the V-shaped female member(52).

Figure 6:
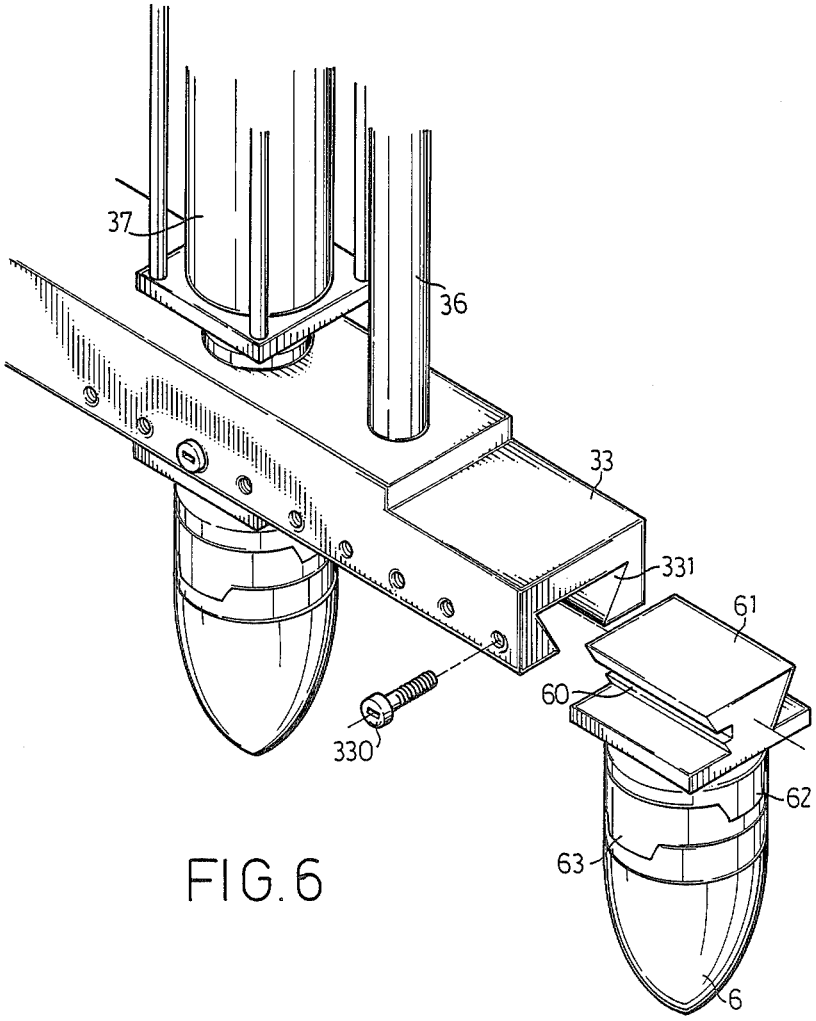
FIG. 6 is a fragmentary view showing a set of silicon rubber heads of the present invention.

Referring to FIG. 6, the silicon rubber head(6) is provided at the top with a dovetail(61) having a pair of lateral grooves(60). The silicon rubber head(6) can engage the suspension arm(33) with the dovetail(61) inserting into the coresponding dovetail groove(331). A screw(330) is used to fix the silicon rubber head(6) in position. The silicon rubber head(6) further is provided with a horizontally adjustable member(62) and a vertically adjustable member(63) which can be used to adjust the position of the silicon rubber head(6) and to facilitate the replacement of the same. A pair of positioning rods(36) together with a pneumatic cylinder (37) are mounted on the top of the suspension arm(33) so as to move with the front slide station(32) wherein the positioning rods(36) are located between the inner side of the guide rods(31) and can move with the cylinder (37) to provide a positioning function.

Figure 7:
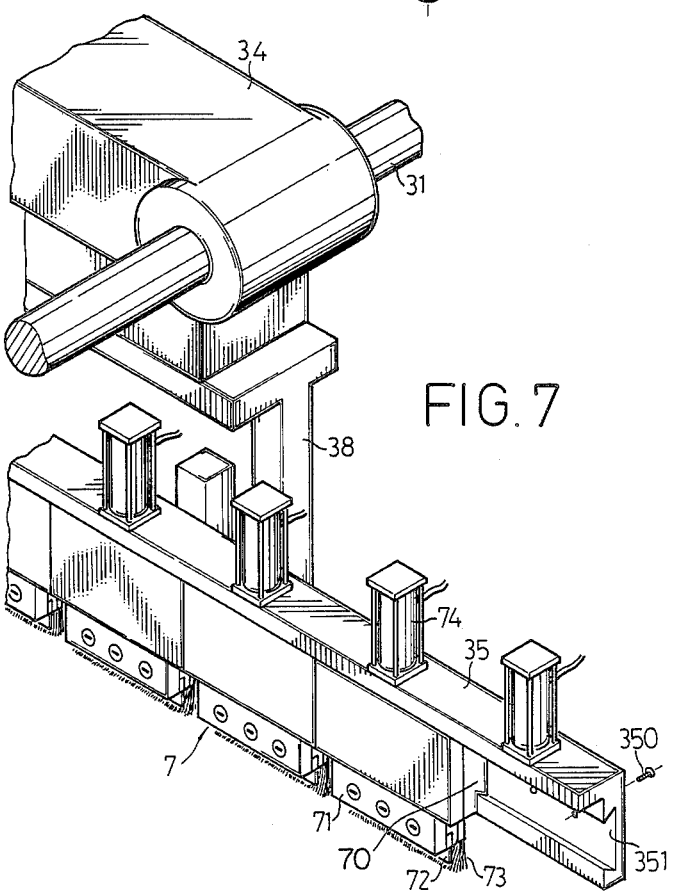
FIG. 7 is a perspective view illustrating the arrangement of a set of blade seats of the present invention.

Referring to FIG. 7, the blade seat(7) is provided at the rear side with a dovetail(70) which can engage the dovetail groove(351) of the suspension arm(35) to make the blade seat(7) secured thereto. A screw(350) is used to fix the blade seat(7) in position. The blade seat(7) has a clamping means(71) by which a blade (72) can be fixed in position. A brush(73) is disposed at the rear side of the clamping means(71). The blade seat(7) is controlled by the corresponding pneumatic cylinder(74) disposed on the suspension arm(35) to be moved up and down. The suspension arm(35) can be moved back and forth with the rear slide station(34) through the aid of the U-shaped frame(38) which is secured to said rear slide station(34). The cylinders (74) are arranged in an equally spaced manner to correspond to various ink containers (4) with different sizes. When the workpiece to be printed is bigger and a larger blade seat(7) is required, the cylinders (74) to be used can be properly selected in such a manner that the unused cylinders (74) can be independently turned off while the other cylinders (74) can be operated synchronously.

Figure 8:
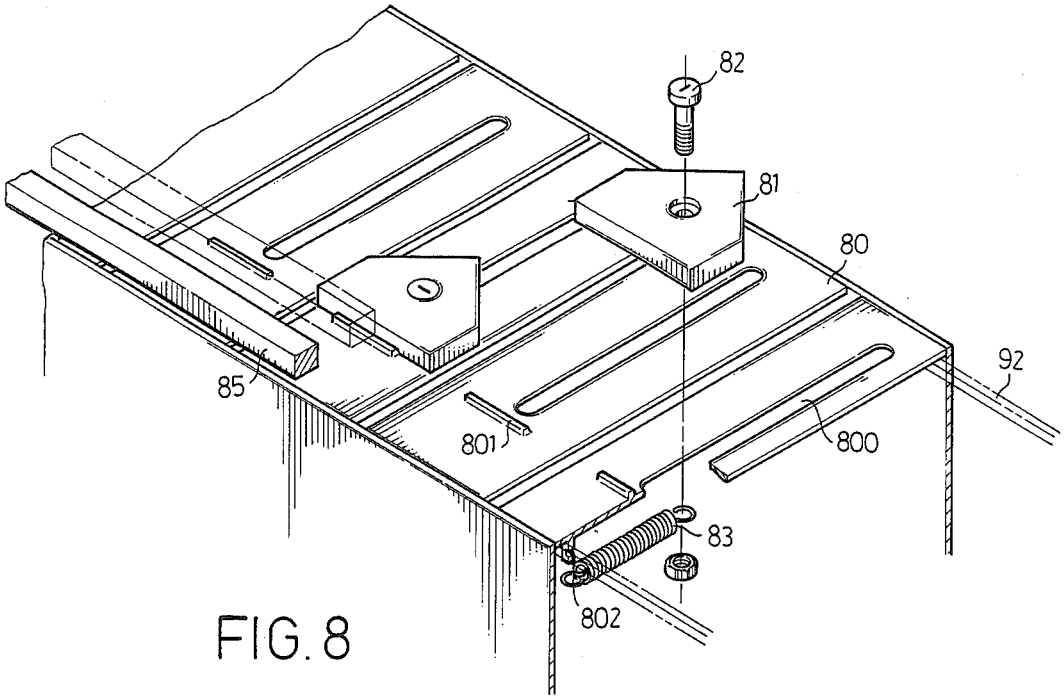
FIG. 8 is a fragmentary view of a conveyor of the present invention.
Figure 9:
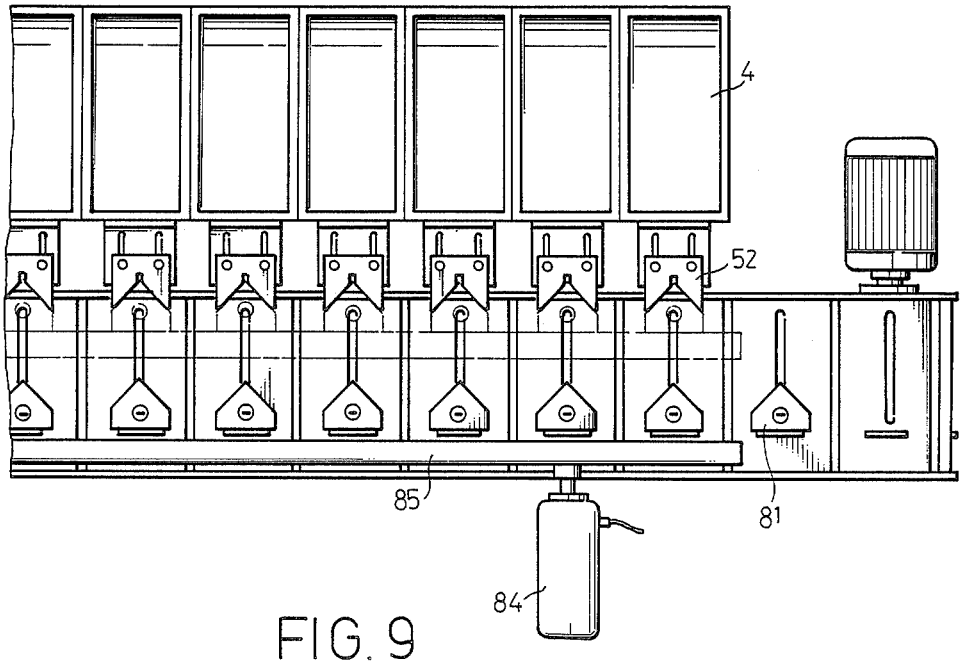
FIG. 9 is a perspective view showing a plurality of V-shaped male members respectively engaging the corresponding V-shaped female members.

Referring to FIGS. 4 and 8, the conveyor (8) is controlled by a numerical control computer system(9) while is driven by a motor(90) associated with a pair of gears(91). Two follow gears are synchronously driven to rotate by said motor through an endless chain(92). A plurality of conveyor stations(80) are respectively fixed to the conveyor(8). Each conveyor station(80) is provided at the top surface with a long slot(800) along which the V-shaped male member(81) can move and is furnished with a stop(801) which can limit the movement of the male member(81). The male member(81) is moveably secured to the conveyor station(80) by means of a screw(82). A spring(83) is connected between a flange(802) formed at the conveyor station(80) and the screw(82). As shown in FIG. 9 the male member(81) can be moved through a moveable rod(85) by the pneumatic cylinder(84), which is fixed to the conveyor(8) (as shown in FIG. 4), to engage the female member(52) on the L-shaped member(5). In this way, the workpiece disposed on the male member(81) can be moved to the printing position. After the workpiece has been printed, the spring(83) will force the male member(81) back to its original position and the stop(801) will limit the male member(81) in position. Then, the conveyor(8) will forward a predetermined distance for the next printing operation. As shown in FIG. 4, between the conveyor stations(80) are provided a plurality of hot air outlets(86) through which hot air will pass to dry the ink printed onto the workpiece.

Before operation, firstly prepare the desired fixture to match the dimension of the workpiece and to be printed and then fix the fixture onto the male member(81). Secondly, according to the desired pattern, prepare the etched plate and then place said etched plate into the front portion of the ink container(4) and supply the rear portion of the ink container(4) with the desired color ink to a level which the brush(73) can touch. Thirdly, adjust the relative positions between the silicon rubber head(6) and the etched plate and the workpiece. Finally, preset the forward displacement per each printing cycle of the conveyor(8).

In operation, firstly, the cylinder (84) pushes the moveable rod(85) to make the male member(81) engage the female member(52) so as to fix the workpiece mounted on the male member(81) to the printing position. Secondly, the hydraulic system(20) moves the front slide station(32) forward a small distance and then moves both the front slide station(32) and the rear slide station(34) forward to the present positions. At this moment, the brush(73) of the blade seat(7) can bring the ink to the etched plate. Thirdly, the blade(72) on the blade seat(7) is lowered and then the front and the rear slide station(32) (34) are moved backward to their original positions. In this way, the blade(72) can scrape off the ink on the etched plate and bring it back to the rear portion of the ink container(4). Fourthly, lower the silicon rubber head(6) to absorb the ink received in the etched portion of the etched plate and then lift the silicon rubber head(6) to its original position. Finally, the silicon rubber head(6) is moved forward to the printing position and print the desired pattern to the workpiece. Then, the cylinder (84) will retract to its original position as soon as the front and rear slide stations(32) (34) retract to their original positions. Meanwhile, the male member(81) is driven to its original position by means of the spring(83). After finishing the aforesaid procedures, the computer(9) will control the conveyor(8) to move forward a predetermined distance and then the above mentioned operating processes will be repeated. During the printing cycle, the hot air coming from the hot air outlets(86) will continuously dry the ink printed onto the workpiece.

It is appreciated that the ink container(4), the silicon rubber head(6), the blade seat(7) and the male/female members(81)(52) of the present invention are all replaceable to adapt for various workpieces with different sizes and shapes. Further, the forward displacement per each cycle of the conveyor(8) is adjustable so as to adapt for the larger workpiece. In principle, the suspension arms(33) and (35), ink container seat(15) and the conveyor(8) of the present invention can be infinitively extended. However, in practical application, there is no need to do so.

Accordingly, the feature of the present invention is characterized in that the major components such as ink containers, blade seats and silicon rubber heads, are all replaceable so that the present invention can provide the printing operation for various workpieces with different sizes and shapes.

I claim:

1. A multi-purpose transfer printing apparatus comprising: a stand; an adjustable seat movably mounted to the stand; first displacement means connected to the adjustable seat for horizontally and vertically displacing the adjustable seat on the stand; an endless conveyor mounted on the adjustable seat; an ink container seat mounted to the stand at a location spaced from the adjustable seat; a main body extending upwardly from the stand; a pneumatic cylinder system mounted to the main body, the main body including an upper portion containing a control system for the pneumatic cylinder system; at least one guide rod connected under the upper portion of the main body at a location over the ink container seat; a front slide station slidably mounted for horizontal movement to the guide rod; a front suspension arm mounted beneath the front slide station; a rear suspension station mounted to the guide rod for horizontal movement there along; a rear suspension arm connected beneath the rear slide station; a plurality of ink containers, each having an L-shaped member and mounted for movement along the ink container seat; a plurality of silicon rubber heads respectively corresponding to the ink containers being arranged for sliding engagement with the front suspension arm; a plurality of blade seats respectively corresponding to the ink containers, the blade seats being mounted for sliding to the rear suspension arm; a blade and a brush connected to each blade seat; a plurality of V-shaped female members fixed respectively to the L-shaped members; a plurality of V-shaped male members each for receiving a work piece to be printed, the male members being disposed on the conveyor for movement along the conveyor; second displacement means operatively connected to the male members for displacing the male members into engagement with the female members, for fixing a relative position between the male and female members to hold work pieces in a printing position for being printed by the rubber heads; and a plurality of pneumatic cylinders operatively connected to the front and rear slide stations and being connected to the pneumatic cylinder system for driving the front and rear slide stations.

2. An apparatus according to claim 1, including a numerical control computer system connected to the conveyor for driving the conveyor to incrementally move the male members, with respect to the female members, when the male members are disengaged from the female members.

3. An apparatus according to claim 1, wherein the suspension arms each have dovetail grooves, the silicon rubber heads and blade seats each having dovetails insertable into the dovetail grooves of their respective suspension arms, the ink container seat having a dovetail groove and the ink containers each having dovetails insertable in the dovetail groove of the ink container seat so that the ink containers, the silicon rubber heads and the blades and brushes of the blade seats are replaceable.

4. An apparatus according to claim 1, wherein the endless conveyor includes a plurality of conveyor stations each with a slot and a stop, a V-shaped male member being mounted to each slot for sliding there along and for engagement against the stop, the second displacement means comprising a movable rod and a pneumatic cylinder connected to the conveyor for moving the movable rod against the male members to move the male members towards the female members.

5. An apparatus according to claim 1, including a pneumatic cylinder connected to each blade seat for lowering the blade and brush of each blade seat.

* * * * *